US010251800B2

(12) United States Patent
Largent

(10) Patent No.: US 10,251,800 B2
(45) Date of Patent: Apr. 9, 2019

(54) LIFTING DEVICE

(71) Applicant: Todd W. Largent, East Peoria, IL (US)

(72) Inventor: Todd W. Largent, East Peoria, IL (US)

(73) Assignee: HOMECARE PRODUCTS, INC., Algona, WA (US)

( * ) Notice: Subject to any disclaimer, the term of this patent is extended or adjusted under 35 U.S.C. 154(b) by 0 days.

(21) Appl. No.: 15/204,777

(22) Filed: Jul. 7, 2016

(65) Prior Publication Data

US 2017/0196745 A1 Jul. 13, 2017

Related U.S. Application Data

(60) Provisional application No. 62/189,381, filed on Jul. 7, 2015.

(51) Int. Cl.
*A61G 7/10* (2006.01)
*B66C 23/20* (2006.01)

(52) U.S. Cl.
CPC ..... *A61G 7/1044* (2013.01); *A61G 7/1076* (2013.01); *B66C 23/201* (2013.01); *A61G 7/1074* (2013.01)

(58) Field of Classification Search
CPC ..... A61G 7/10; A61G 7/1074; A61G 7/1044
USPC ..... 212/223–253
See application file for complete search history.

(56) References Cited

U.S. PATENT DOCUMENTS 6,860,703 B2 * 3/2005 Carroll, Jr. ..... B60P 1/5433 212/223
7,178,181 B1 2/2007 Fulmer
2014/0360961 A1 * 12/2014 Steffes ..... F16L 27/087 212/251

* cited by examiner

*Primary Examiner* — Ronald P Jarrett
(74) *Attorney, Agent, or Firm* — Christensen O'Connor Johnson Kindness PLLC; Emily Peyser; Kyle Yarberry

(57) ABSTRACT

A lifting device, configured to attach to a lifting head and sling to move a disabled person from one location to another including a support column, a first arm, a second arm, and a friction brake. The support column includes an axis and is configured to attach between two stationary surfaces. The first arm is fixedly connected to the support column. The second arm is pivotally connected to the first arm at a pivot joint. The second arm is configured to connect to the lifting head. The support column and first arm are configured to rotate around the axis, and the second arm is configured to pivot around the pivot joint such that the second arm second end rotates three hundred and sixty degrees around the axis.

12 Claims, 1 Drawing Sheet

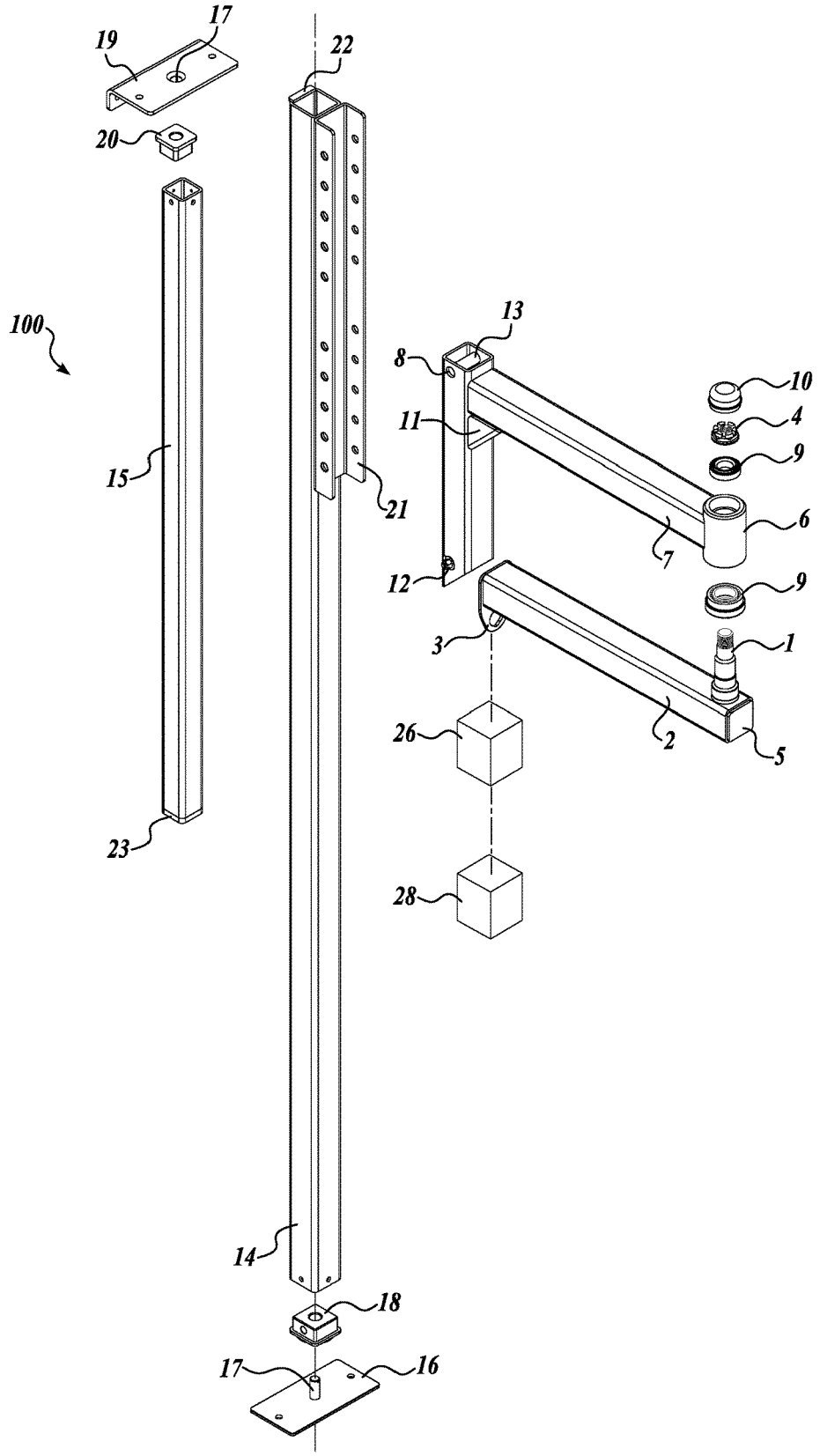
17
19
22
20
100
13
8
10
11
4
9
15
21
6
7
12
9
3
1
26
2
5
23
28
14
18
17
16

LIFTING DEVICE

PRIORITY

This application claims priority to and incorporates by reference in its' entirety, U.S. Provisional Patent Application No. 62/189,381, entitled "Lifting Device", and filed Jul. 7, 2015.

TECHNICAL FIELD

The present invention generally relates to lifting devices for moving disabled persons from one location to another.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

In one aspect of the present invention, a lifting device is configured to attach to a lifting head and sling to move a disabled person from one location to another. The lifting device includes a support column, a first arm, a second arm, and a friction brake. The support column includes an axis and is configured to attach between two stationary surfaces. The first arm includes a first arm first end and a first arm second end, and is fixedly connected to the support column at the first arm first end at an angle between eighty-two degrees and ninety-eight degrees. The second arm includes a second arm first end and a second arm second end. The second arm first end is pivotally connected to the first arm second end at a pivot joint. The second arm second end is configured to connect to the lifting head. The support column and first arm are configured to rotate around the axis, and the second arm is configured to pivot around the pivot joint such that the second arm second end rotates three hundred and sixty degrees around the axis. The friction brake is configured to slow the rotation of the support column and first arm around the axis.

BRIEF DESCRIPTION OF THE DRAWINGS

FIG. 1 is an exploded view of a lifting device, according to an embodiment of the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Referring to FIG. 1, a lifting device 100 is shown in exploded view. The lifting device 100 may provide a safe and convenient device for transferring and lifting individuals with physical disabilities. The lifting device 100 may comprise part of a system that allows individuals to easily be transferred and lifted from one position to another. A portable lift head 26 and sling 28 (shown schematically) may be connected to arm B 2 to make the moving and transferring easy. The caregiver's confidence may be increased and the risk for injury may be reduced. With a single joint and a 360 degree pivoting main shaft support with friction brake 18 the lifting device 100 may act like an arm that can spin around 360 degrees. The ability to slow down the main shaft pivoting, with a brake, may provide more control. Providing a standard floor to wall or floor to ceiling mount system, may provide flexibility. The lifting device 100 may be used with a variety of ceiling heights including 8, 10 and even 12 feet. When wall mounted and not in use, the arm may be folded in half and may lay it flat to the wall and out of the way. When mounted in the middle of the room from floor to ceiling the arm may be folded in half and positioned in any direction for compact storage. Different reaches with different weight limits may be used. Examples may include a weight capacity of 400 lbs with a 4' reach and an 8' radius; and a weight capacity of 350 lbs with a 5' reach and a 10' radius. Many different types of portable lift heads 26 and slings 28 may be attached to the lifting device 100 to move a disabled person.

With some installations of the lifting device 100, the arm may be able to reach through a door opening so that an individual can be transferred from outside a doorway into a room and back out. Multiple lifting devices 100 may be placed in a home or other building to form a system for moving a disabled person. A portable lift head may be moved from one lifting device 100 to another to move a disabled person between many locations in the home or building. The lifting device 100 may be mounted between a floor and a wall, or alternatively between a floor and a ceiling. Other stationary mounting surfaces may also be used.

Chart A below shows exemplary components of the lifting device 100 and the element number they are associated with in FIG. 1.

CHART A

| Item No. | Part Description | Exemplary Embodiment - Further Description | Quantity |
|---|---|---|---|
| 1 | Arm B Spindle - 02 | 1045 CR | 1 |
| 2 | Arm B Tube | 2.5 × 2.5 × .12 Square Tube | 1 |
| 3 | Hook Tab - 02 | 3/16 Steel Plate | 1 |
| 4 | Castle Nut | | 1 |
| 5 | End Cap | 3/16 Steel Plate | 1 |
| 6 | Hub B - 01 | 1020 DOM Tube | 1 |
| 7 | Arm A Tube - 02 | 2.5 × 2.5 × .12 Square Tube | 1 |
| 8 | Hub A | 2.5 × 2.5 × .12 Square Tube | 1 |
| 9 | Tapered Roller Bearing | | 2 |
| 10 | Dust Cap | | 1 |
| 11 | Arm A Brace - 02 | 2.5 × 2.5 × .12 Square Tube | 1 |
| 12 | Plain Hex Nut | | 6 |
| 13 | Hub A Bushing | 1020 DOM Tube | 1 |
| 14 | Main Column | 2.5 × 2.5 × .12 Square Tube | 1 |
| 15 | Telescoping Column | 2.0 × 2.0 × .12 Square Tube | 1 |
| 16 | Column Foot - 00 | 3/16 Steel Plate | 1 |
| 17 | Tube Pin | 1018 CR | 2 |
| 18 | Bushing Flange | Delrin | 1 |
| 19 | Wall Bracket | 3/16 Steel Plate | 1 |
| 20 | Bushing Flange | Delrin | 1 |

CHART A-continued

| Item No. | Part Description | Exemplary Embodiment - Further Description | Quantity |
|---|---|---|---|
| 21 | Adjustment Channel | 3/16 Steel Plate | 1 |
| 22 | Reducer Plate | 3/16 Steel Plate | 1 |
| 23 | Guide Cap | 3/16 Steel Plate | 1 |
| | 1-2-13 Flat Nose Set Screw | | 5 |

Chart B shows exemplary components of the lifting device with exemplary materials the components may be comprised of and exemplary strengths.

CHART B

| Component | Material Name | Yield Strength (ksi) |
|---|---|---|
| Arm-A Tube | ASTM A500 | 39 |
| Arm-B Tube | ASTM A500 | 39 |
| Main Column | ASTM A500 | 39 |
| Arm-B Spindle | 1045 CR | 75 |
| Hub-A | ASTM A500 | 39 |
| Hub-B | ASTM A513 1020 Steel | 60 |
| Hook Tab/Other Steel Plates | A36 Steel Plate | 36 |
| Bushing Flange 225/250 | Delrin | 9.5 |

It should be understood, of course, that the foregoing relates to exemplary embodiments of the invention and that modifications may be made without departing from the spirit and scope of the invention as set forth in the following claims.

I claim:

1. A lifting device, configured to attach to a lifting head and a sling to move a disabled person from one location to another, comprising:

a support column with an axis configured to attach between two stationary surfaces;

a height adjustment channel affixed to the support column and comprising a plurality of height adjustment apertures;

a hub adjustably coupled to the height adjustment channel through at least one of the height adjustment apertures;

a first arm with a first arm first end and a first arm second end, the first arm first end being connected with the hub at an angle between eighty-two degrees and ninety-eight degrees;

a second arm with a second arm first end and a second arm second end, the second arm first end pivotally connected to the first arm second end at a pivot point and the second arm second end configured to connect to the lifting head; and a friction brake;

wherein the support column and first arm are configured to rotate around the axis and the second arm is configured to pivot around the pivot point such that the second arm second end can rotate three hundred sixty degrees around the pivot point and the friction brake is configured to slow rotation of the support column and first arm around the axis.

2. A moving device, comprising:

a support column configured to attach between two stationary surfaces, the support column having a longitudinal axis, an outer surface, an upper end, and a lower end;

an arm assembly comprising a hub, a first arm having a first end and a second end, the first end of the first arm being connected with the hub such that a majority of a length of the hub extends away from the first arm toward one of the upper and lower ends of the support column, the hub being coupled to the support column and the second end extending away from the support column, and a second arm having a first end and a second end, the second arm first end pivotally connected to the first arm second end at a pivot point and the second arm second end coupled with a connection means for attaching to an object, wherein the first arm is configured to rotate around an axis that is parallel to a longitudinal line on the outer surface of the support column and the second arm is configured to pivot around the pivot point such that the second arm second end rotates three hundred sixty degrees around the pivot point; and a height adjustment means for adjusting a height of the arm assembly relative to the support column.

3. The moving device of claim 2, wherein the first arm is substantially perpendicular to the axis.

4. The moving device of claim 2, wherein the first arm is coupled to the support column at an angle between eighty-two degrees and ninety-eight degrees.

5. The moving device of claim 2, wherein the first arm is configured to rotate around the longitudinal axis of the support column.

6. A method of moving an object using a lifting device, the method comprising:

connecting an object to a sling of the lifting device, the lifting device including a support column attached between two stationary surfaces and having a longitudinal axis, the support column being affixed to a height adjustment channel comprising a plurality of height adjustment apertures, a first arm having a first end and a second end, wherein the first arm is connected to at least one of the plurality of height adjustment apertures at the first arm first end, and a second arm having a first end and a second end, the second arm first end coupled to the first arm second end by a pivot coupling such that it is configured to rotate three hundred sixty degrees about the first arm second end, and the second arm second end configured to support a lifting head and the sling, and a friction brake configured to slow rotation of the first arm around the longitudinal axis of the support column;

rotating the object around the longitudinal axis of the support column and using the friction brake to slow the rotation of the sling around the longitudinal axis of the support column; and rotating the object around an axis substantially parallel to the longitudinal axis of the support column and extending through the pivot coupling of the second arm first end and the first arm second end.

7. The method of claim 6, wherein the object is a person.

8. A moving device, comprising:

a support column with an axis, the support column configured to attach between two stationary surfaces;

a height adjustment channel affixed to the support column and comprising a plurality of height adjustment apertures;

a hub adjustably coupled to the height adjustment channel through at least one of the height adjustment apertures;

a first arm having a first arm first end and a first arm second end, the first arm first end being connected with the hub; and a second arm with a second arm first end and a second arm second end, the second arm first end pivotally connected to the first arm second end at a pivot point and the second arm second end including a connection means for an object, wherein the support column and first arm are configured to rotate around the axis and the second arm is configured to pivot around the pivot point such that the second arm second end can rotate three hundred sixty degrees around the pivot point.

9. The moving device of claim 8, wherein the plurality of height adjustment apertures comprises a first plurality of height adjustment apertures that extend through a first wall of the height adjustment channel, and a second plurality of height adjustment apertures that extend through a second wall of the height adjustment channel.

10. The moving device of claim 9, wherein the hub is couplable with at least one of the first plurality of height adjustment apertures.

11. The moving device of claim 10, wherein an arm brace extends from the hub to the first arm to support the first arm.

12. The moving device of claim 11, the support column comprising a friction brake that is configured to slow rotation of the first arm.

* * * * *